US005704222A

United States Patent [19]

Hage et al.

[11] Patent Number: 5,704,222

[45] Date of Patent: Jan. 6, 1998

[54] REFRIGERATING APPARATUS AND METHOD

[75] Inventors: Robert M. Hage, Welling, United Kingdom; Michael Anthony, Coral Springs, Fla.

[73] Assignee: Cold Pack Technologies USA, Inc., Pompano Beach, Fla.

[21] Appl. No.: 534,453

[22] Filed: Sep. 27, 1995

[51] Int. Cl.[6] ..... F25D 3/10

[52] U.S. Cl. ..... 62/293; 62/371

[58] Field of Search ..... 62/293, 371, 457.3, 62/457.4, 294

[56] References Cited

U.S. PATENT DOCUMENTS

| | | | |
|---|---|---|---|
| 2,515,840 | 7/1950 | Rodeck | 62/294 |
| 3,494,142 | 2/1970 | Beck | 62/371 |
| 3,759,060 | 9/1973 | Chase | 62/371 |
| 3,881,321 | 5/1975 | Riley | 62/293 |
| 4,628,703 | 12/1986 | Kim | 62/371 |

*Primary Examiner*—William E. Tapolcai
*Attorney, Agent, or Firm*—Oltman, Flynn & Kubler

[57] ABSTRACT

A rapid refrigeration apparatus and method for beverages having a container (10) with a flexible thin-film aluminum or plastic receptacle (16) secured to an upper end of the container (10) by way of an expansion nut (18). The receptacle (16) has a variable volume and is arranged to be in thermal contact with an internal region of said container. A refrigerant is placed within said receptacle and as the volume of the receptacle decreases during collapse due to evaporation of escaping refrigerant provides cooling of the container's contents.

25 Claims, 10 Drawing Sheets

REFRIGERATING APPARATUS AND METHOD

The present invention relates to a refrigerating apparatus and method.

It has long been known, for a variety of reasons, to cool the contents of a container. Such a requirement commonly arises in the food/beverage industry where the content of product in the container is often required to be cooled or refrigerated so as to achieve a required longevity and/or enhance the consumer satisfaction of the product.

While it is commonly known to refrigerate a beverage or food product at the point of sale of that product to a potential customer, such a customer does not always wish to consume the product at the time of purchase or supply and so such known refrigeration apparatus does not necessarily meet the principle requirement of the customer, i.e. that the product remains, or is, at a preferred low temperature at the time of consumption. This requirement particularly arises in relation to bottled and canned beverages.

Whilst some attempts have been made to incorporate a refrigeration device into the product container itself, such known attempts have proved unsuccessful and disadvantageous in that they are restrictive, relatively expensive, relatively ineffective and inefficient and disadvantageously restricted in that they cannot be readily incorporated into established automated bottling/canning facilities. Further, the incorporation of such known devices into product containers can disadvantageously allow for escape of the product. Also, the rigidity of such known devices also leads to disadvantages associated with hoop and lateral stresses developed therein, and can also prove potentially dangerous in that the possibility of the device exploding cannot be satisfactorily eliminated. Such known devices cannot adapt to the changing circumstances, e.g. temperature of the product and volume of refrigerant, and so are also disadvantageously restrictive and inefficient.

The present invention seeks to provide for an apparatus and method for cooling the contents of a container and which have advantages over known such apparatus and methods.

In accordance with a first aspect of the present invention, there is provided apparatus for cooling the contents of a container, comprising a receptacle having a variable volume and arranged to be in thermal contact with an internal region of said container.

The invention can then exhibit a particular advantage in that as the volume of the receptacle decreases, i.e. during its collapse due to evaporation of the refrigerant, the remaining refrigerant is urged into contact with an increasing surface area of the receptacle wall so as to enhance the continued evaporation thereof and thus the cooling of the container's contents.

The receptacle may comprise interconnected sliding wall portions, each of which may be rigid, or may comprise one or more flexible-walled members.

If in the form of a balloon-like member, the receptacle advantageously can expand to the exact volume of, for example, the head space in a beverage container.

Preferably, said apparatus comprises a receptacle for insertion in said container and for contacting said contents, and arranged to receive a refrigerant and to at least partially expand due to said receipt, and to allow for the expulsion of said refrigerant by the evaporation thereof and to at least partially collapse during said expulsion.

The receptacle may advantageously comprise a receptacle having a definite maximum potential, i.e. fully expanded, volume arranged to exceed the volume required to be occupied within the container. Alternatively, the receptacle can be formed of resilient wall portions, e.g. in the form of a balloon.

The present invention is particularly advantageous in that it can readily respond to the increase in the pressure therein during the supply of the refrigerant. The receptacle can then advantageously be retained in a state in which it does not reach its full expansion and in which the pressure inside the receptacle equals the pressure of the contents outside the receptacle. The receptacle can then advantageously be formed of flexible walls of which are not then subject to any disadvantageous forces or stresses.

Advantageously, said receptacle has venting means for ready communication of the inside thereof with atmosphere to achieve the evaporation of said refrigerant.

Further, the flexibility of the walls of the receptacle, and the potential for expansion thereof, can readily allow for the receptacle to move within the contents of the container so as to occupy substantially if not all of the head space otherwise found above the contents in the container.

Preferably, the receptacle can be charged with said refrigerant and activated so as to allow for the escape of the evaporating refrigerant by way of selectively openable sealing means. Advantageously, the selectively openable sealing means also comprises an initially resealable closure member.

Preferably, prior to the expansion of said receptacle, said receptacle is in a collapsed, curled or otherwise folded state. The receptacle can then advantageously be arranged to occupy a minimum possible volume so as to enhance the storage/transportation and manufacture of the container and the component parts thereof.

Advantageously, said flexible receptacle comprises a bag. Alternatively, said receptacle can comprise a curled tube member or, according to a further alternative, a telescopic member. In the latter case, the receptacle has a principle flexibility in the direction of the telescoping action thereof and the aforementioned telescoping action readily allows for the, at least, particle expansion/collapse of the receptacle as required.

Advantageously, the receptacle is formed from a thin material so as to provide for a thin walled receptacle. Such material may comprise a thin metal foil material such as aluminium foil or a thin plastic material such as polyethylene. Having regard to this latter feature, the receptacle can then advantageously comprise a polythene bag.

The receptacle can then be provided in a particularly cost effective manner and the wall of the receptacle is particularly suitable for achieving the advantages of the present invention which arise from the ability of the receptacle, and in particular its surface area, volume and shape, to change in response to pressure changes both internal and external to the receptacle.

Further, the bag is preferably arranged to be formed of a suitable material that can effect the sealing of an opening to the container. The at least partially expanded receptacle can then advantageously assist in preventing an undesired early opening of the container and thus an undesired early access to the contents thereof. This may prove advantageous in not only preventing accidental spillage of the contents of the container, but may also serve to retain the quality and freshness of the contents until such time as the requirement for consumption arises.

As mentioned above, the dimensions of the receptacle are advantageously chosen so that, having regard to the head space to be found in the container which is to receive the receptacle, the receptacle, once charged with the refrigerant, will not expand to its full extent so that undue pressure and stress on the flexible wall of the receptacle does not arise. The wall of the receptacle then advantageously experiences a pressure balance between the pressure of the content outside the receptacle and the pressure of the refrigerant inside the receptacle.

According to a further advantageous feature of the present invention, the wall of the receptacle is advantageously arranged to collapse during the evaporation of the refrigerant in a manner which, although allowing for a reduction in the volume of the receptacle, maintains the surface area of the receptacle in contact with the contents of the container and so advantageously serves to maintain the required evaporation process even during the continued cooling of the contents of the container.

Preferably, the receptacle is arranged to be mounted within the container.

In one embodiment, the receptacle is provided on part of the mounting member that is arranged to be received in an aperture of the container. The mounting member advantageously can be provided with a sealing member so that once the receptacle is introduced into the container, the aperture through which it is received is advantageously hermetically sealed. As such, the mounting member advantageously includes a securing member, such as an expansion nut, in which either a press-fit, or screw action is required to effect the expansion of the sealing member in a lateral direction so as to seal the aperture.

The mounting member then advantageously also provides for a passage through which the refrigerant can be introduced to the receptacle and a releasable closure member which can be selectively released via said passage so as to effect the evaporation of the refrigerant when required.

Preferably, the receptacle means may comprise a plurality of receptacles, preferably in mutual communication. The plurality of receptacles can be connected in series, in parallel or concentrically.

In another embodiment of the present invention, the receptacle is advantageously secured to an inside surface of the container. Preferably, the receptacle is advantageously secured to the underside of the lid of the container. In particular, the receptacle can be attached thereto by any suitable adhesive means. However, the receptacle can of course be secured to, or in the region of, and particular peripheral region of the container whether the top, bottom or side thereof. The access point to the container's contents and/or the receptacle's contents can then be provided at such a peripheral location.

Irrespective of the means of mounting the receptacle within the container, venting means are advantageously provided so as to allow for the escape of the air and/or gases previously found in the head space. Such venting means can advantageously be arranged to operate during the insertion of the aforementioned mounting member or can comprise any appropriate form of "bleed aperture" which is of a sufficient size to allow for the escape of gas, but not fluid.

Preferably, said receptacle can be arranged to self-locate within the container. Such a feature principally arises when the contents of the container comprise a liquid in that the receptacle can be advantageously arranged to float within the liquid up to a position in which it can be securely located prior to the introduction of the refrigerant therein.

Preferably, the receptacle is provided with a resealable opening which allows for the introduction of a floatation medium which assists in the expansion, and thus floatation of the receptacle up into a position in which it can occupy substantially all of the head space in the container.

Advantageously, the floatation medium can comprise a refrigerant.

It will be appreciated that the receptacle can thus advantageously be arranged to receive a small charge of supercooled liquid gas, for example liquid carbon dioxide or liquid nitrogen. Upon the evaporation of the liquid gas, the receptacle is caused to expand and thus float upwardly within the contents of the container and, by the provision of suitable location/attachment means, the receptacle can then be appropriately located within the container.

Advantageously, the location/attachment means can comprise an adhesive member arranged to contact a portion of the receptacle once the aforementioned floatation has occurred.

Preferably, the receptacle is provided with a sealing member which is arranged for engagement with engagement formations of the inner surface of the container so as to effect the secure location of the receptacle therein.

Further, the sealing member can advantageously be arranged to provide a wall of the container or, alternatively, can be arranged to form an inner lining to such a wall of the container. With regard to the latter feature, the said wall of the container can be provided with an opening through which a closure member of the receptacle can extend. Advantageously, at least part of the sealing member and/or the expanded receptacle can serve to seal the opening in the said wall member. The closure member of the receptacle can then be advantageously readily located and manipulated so as to effect either further charging of the receptacle, or the activation thereof by allowing for the evaporation of the refrigerant located therein to atmosphere.

In line with a further advantage of the present invention, the receptacle is provided with ball valve means which serves to prevent escape of any liquified refrigerant if the receptacle and/or the container are tipped to such a location at which such escape might be possible. Advantageously, the ball valve is also effective to prevent any escape of the refrigerant prior to the required activation of the apparatus.

Preferably, the receptacle can be arranged to be mounted as part of a screw cap, or screw closure, of the container.

The receptacle can then advantageously be incorporated into a bottle or jar.

Further, the receptacle can be provided integrally with the screw cap and, advantageously, can be provided with a neck portion which is arranged to expand at least to a minor degree, along with the expansion of the receptacle. The cylindrical neck portion is advantageously provided with engagement formations which, upon the expansion of the neck portion, serve to engage with an inner surface of the container. Preferably, said inner surface of the container is also provide with complimentary engagement formations for receiving, and biting with, the aforementioned first engagement formations.

Advantageously, the container comprises a beverage container such as a can or bottle. The contents of the container can then comprise any form of beverage whether alcoholic, or non-alcoholic, or carbonated or non-carbonated.

Advantageously, the refrigerant comprises a refrigerant having relatively good thermodynamic properties at room temperature. For example, the refrigerant may comprise an HFC such as HFC-152a, Dymel-Dymethylether a, or HFC-134a etc.

However, it should be appreciated that any combination of appropriate gases may be employed and HFC-152a and HFC-134a merely serve as examples. In particular, advantageously cost effective flammable gases may be employed as the refrigerant since the receptacle can readily be arranged such that the velocity of gas exiting from the receptacle can arrange to be high enough to exceed the flame speed limit of the gas. This can advantageously prevent combustion of the whole refrigerant in the receptacle occurring in any situation in which the escaping refrigerant might accidentally be ignited.

According to another aspect of the present invention, there is provided a container having a receptacle therein and as defined above.

According to a yet further aspect of the present invention, there is provided a method of cooling the contents of a container, the method comprising the steps of opening a receptacle of variable volume located for thermal contact with the inside of the container to atmophere.

Preferably, the opening of the receptacle allows for the at least partial collapse of said receptacle and for the escape of evaporating refrigerant previously introduced into the receptacle.

Advantageously the method further comprises first charging the receptacle with a refrigerant so as to cause the at least partial expansion thereof.

Preferably, said expansion occurs to a size and shape which does not represent the maximum possible expansion of the receptacle.

Preferably, the initial charging of the receptacle also serves to cause the floatation thereof through the content of the container and into a required portion in the upper region of the container.

Advantageously, the receptacle is caused to expand so as to occupy the head space found within the container.

Preferably, the method involves the use of a receptacle as defined in any one of the definitions above or as described herein.

It will therefore be appreciated that the present invention provides for a particularly cost effective and efficient manner in which the contents of a container can be readily cooled by the intended end user of the container, i.e. consumer of the contents, as and when required.

The invention is described further hereinafter, by way of example only, with reference to the accompanying drawings in which.

Figure 19:
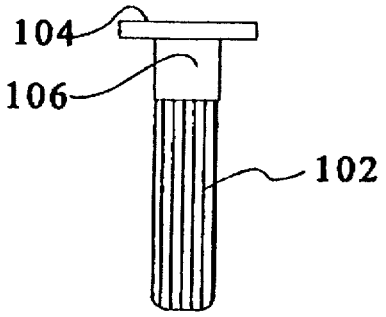
Figure 20:
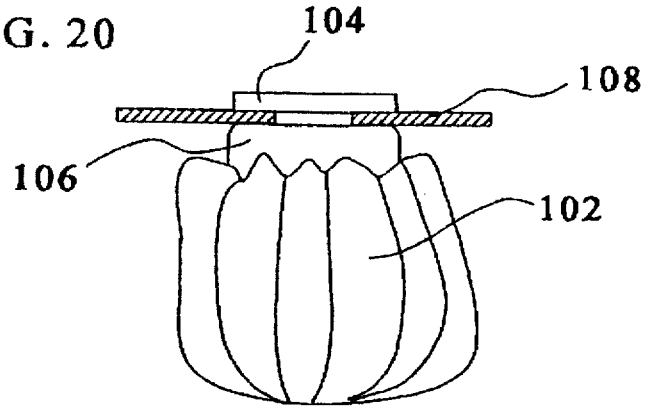
Figure 21:
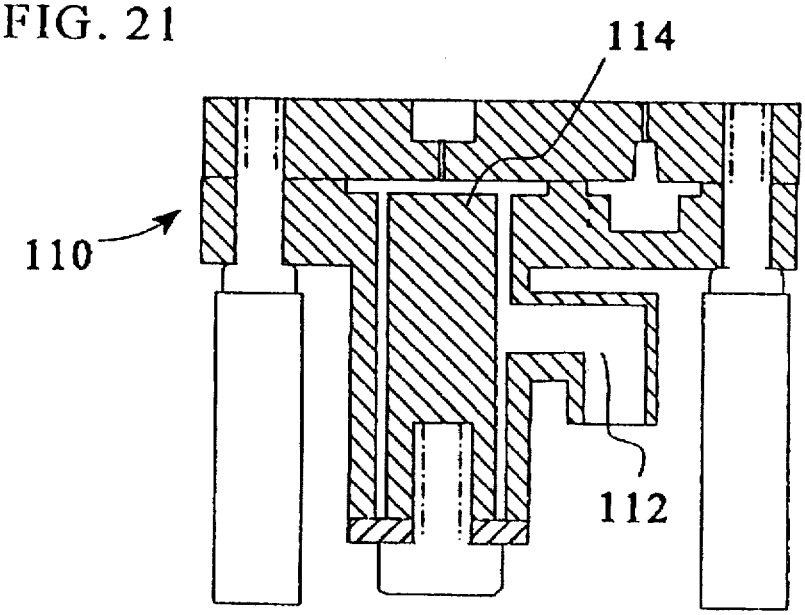
Figure 22:
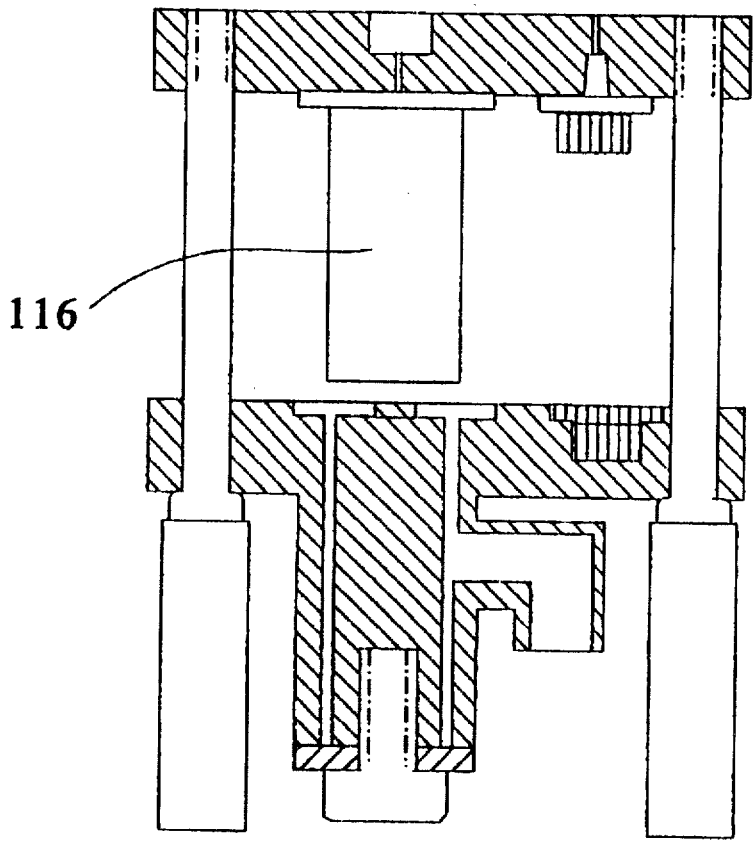

FIGS. 19 and 20 comprise side elevational views of receptacle according to the first embodiment of the present invention but formed integral with a mounting member; and FIGS. 21 and 22 are schematic representations illustrating one example of means for forming the receptacle of FIGS. 19 and 20.

Figure 1:
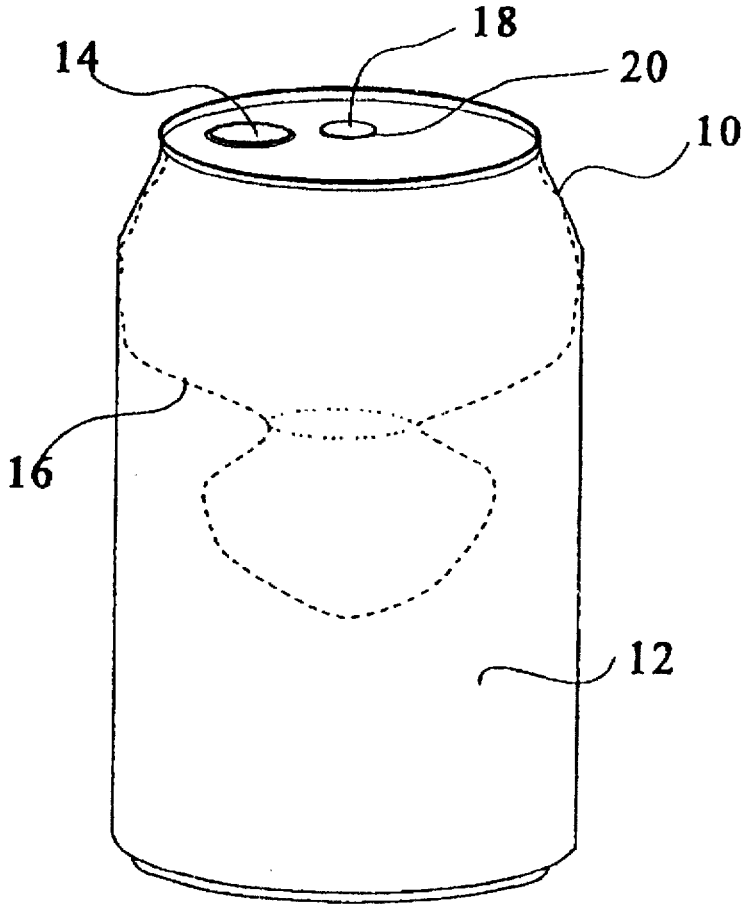
FIG. 1 is a perspective view of apparatus according to one embodiment of the present invention.

As illustrated in FIG. 1 there is provided a beverage can 10 having a drink product 12 contained therein. The upper end portion of the can 10 is provided with a beverage outlet aperture 14.

Within the can 10 there is also provided a part expanded bag 16, which can comprise a thin-film aluminium bag or thin-plastics bag such as a polyethylene bag, and which is mounted on the upper end of the can 10 by way of an expansion nut 18. The expansion nut engages part of a neck portion (not seen in FIG. 1) of the bag 16 which extends through an aperture 20 in the upper end of the can 10.

The expansion nut 18 is advantageously made of plastic or rubber.

As will be appreciated from FIG. 1, expansion of the bag 16 as illustrated has occurred so that the bag 16 occupies the previous volume of the head space found within the can 10. Thus, within the can 10, there is only found the beverage 12 and the part expanded bag 16.

The part expanded bag 16 is a particular feature of the present invention and one that can advantageously be found in all of the embodiments illustrated herein.

The potential maximum volume of expansion of the bag 16 can be arranged so that, in reaching a volume sufficient to fill the head space otherwise appearing in the can 16, i.e. in which the head space is completely taken over by the bag 16, the thin flexible walls of the bag 16 do not suffer any disadvantageous stresses or forces. This advantageous equilibrium situation arises since the thin walls of the bag 16 have not been stretched to reach the maximum potential volume of the bag 16 and the pressure within the bag 16 equals that of the beverage 12 outside the bag 16.

As will be appreciated from the further discussion below, the pressure arising within the bag 16 is due to the refrigerant introduced therein by way of the neck of the bag (not shown in FIG. 1) which extends through the opening 20 in the upper end wall of the can 10 and to the expansion nut 18.

As will also be appreciated further hereinafter, an openable seal is formed as part of the expansion nut 18 so that, as and when required, the contents of the bag 16 can be caused to communicate with atmospheric pressure and temperature.

It will also be appreciated from FIG. 1 that an upper portion of the bag 16 extends directly below the beverage outlet aperture 14. Through an appropriate choice of the refrigerant material introduced into the bag 16, and thus the buoyancy thereof, the aforementioned upper portion of the bag 16 can be forced into sealing engagement with the periphery of the outlet 14 so as to prevent the escape of beverage therefrom. It will then be seen that the can 10 can be effectively opened so as to release the drink product solely upon deflation, or collapse, of the bag 16.

This therefore advantageously provides for an effective means for allowing for the sealing and quick and effective opening, of the can 10 as and when required.

Figure 2:
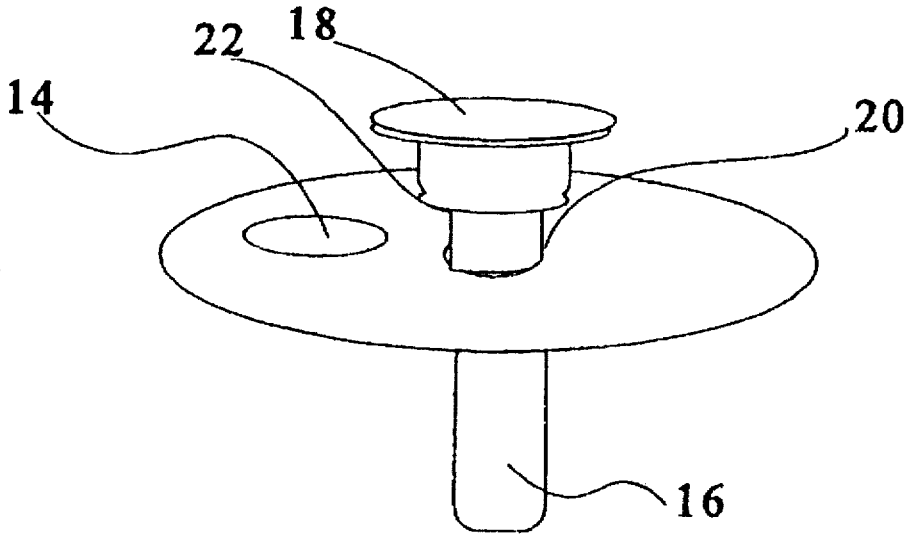
FIG. 2 is a perspective view of part of the apparatus of FIG. 1 on an enlarged scale.

Referring now to FIG. 2, the arrangement of the upper portion of the apparatus of FIG. 1 is shown in further detail. In FIG. 2, the bag 16 is shown in its initial collapsed, or folded, state in which it is introduced via an opening 20 in the upper end of the can 10 by virtue of its attachment to the expansion nut 18. The opening 20 may be located central to the upper end of the can 10, or may be offset to the center thereof. Just below the expansion nut 18 there is provided a seal member 22 which may, for example, comprise an aluminium, rubber or plastic seal member 22, and which, upon tightening of the expansion nut 18, extends in a lateral direction having regard to the longitudinal axis of the expansion nut 18 and folded bag 16, so as to seal the opening 20.

Figure 3:
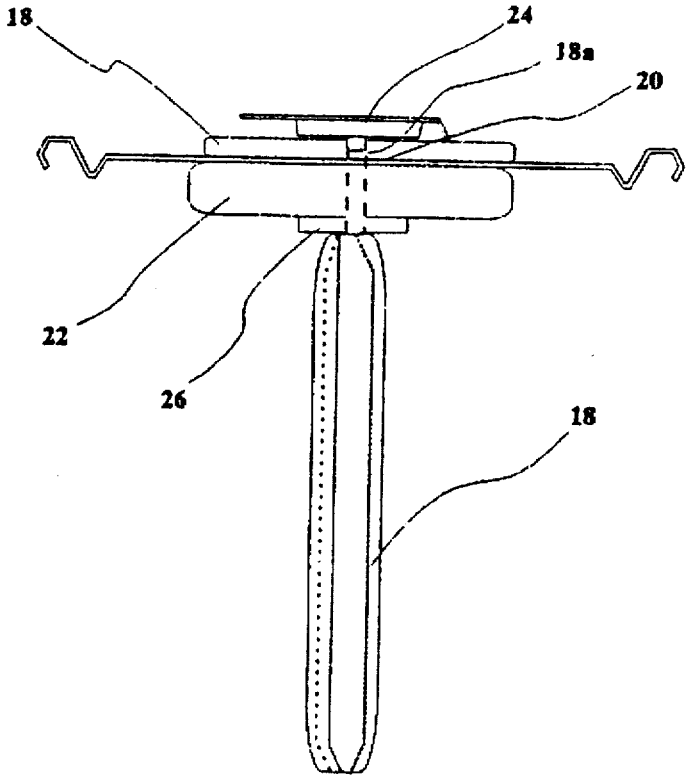
FIG. 3 is a sectional view of the part of the apparatus of FIG. 1 shown in FIG. 2.

The sealing of the opening 20 is illustrated further in FIG. 3 which also serves to illustrate a closure cap member 24 which, not only allows for the introduction of refrigerant material into the initially folded receptacle 16, but also serves to prevent the escape of evaporating refrigerant material from the at least part expanded bag 16 illustrated in FIG. 1.

Figure 4:
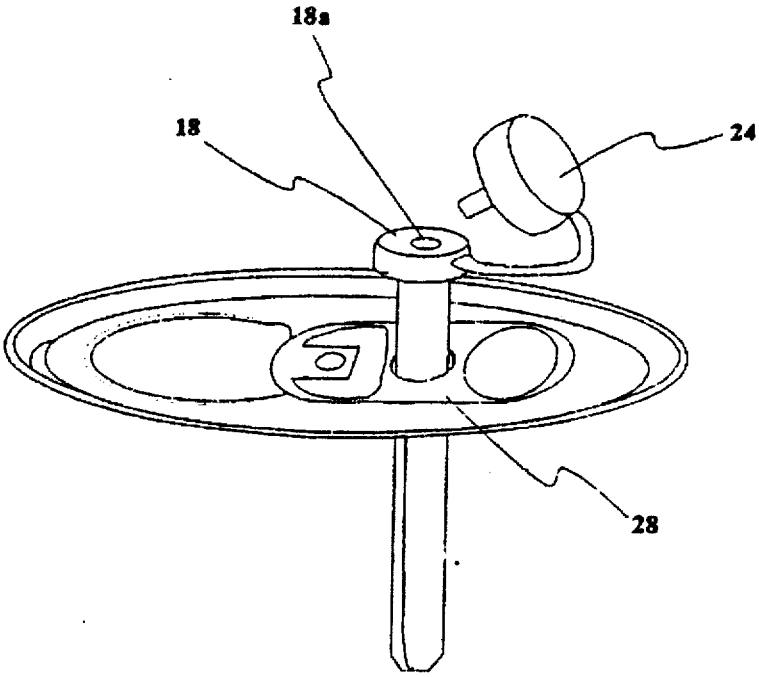
FIG. 4 is a perspective view of apparatus according to the first embodiment and for use with a different form of container.

FIG. 4 indicates that the embodiment of the present invention discussed in relation to FIGS. 1–3 can also be readily incorporated into a can 10 having a conventional top wall portion with a conventional ring-pull mechanism 28 attached thereto.

However, to advantageously prevent the undesired early opening of the can 10, i.e. before the drink product 12 has an opportunity to cool to the required temperature, the pressurised bag 16 can again extend under the inner surface of the top wall of the can 10 and can exert a pressure against the flat member of the ring pull mechanism 28. This serves to prevent the activation of the ring pull mechanism 28, and thus the opening of the can 10 until such time as the bag has become at least partially deflated or collapsed, at which time—as will be appreciated from the following discussion—the contents of the bag 16 have been exposed to atmospheric pressure and temperature and so effected the cooling of the drink product 12 in the can 10.

It will of course be appreciated that the sealing effected by the expansion nut 18 can be arranged to occur only once the bag 16 has expanded to occupy a volume equivalent to the head space otherwise found within the can 10. This allows for the required escape of gas and/or air from the head space during expansion of the receptacle. Once this has occurred, sealing by the seal 22 of FIG. 2 can then be effected. As an alternative, the expansion nut need not comprise a screw-threaded member but may comprise a press fit member which serves to deform the seal 22 as illustrated in FIG. 3.

Figure 5:
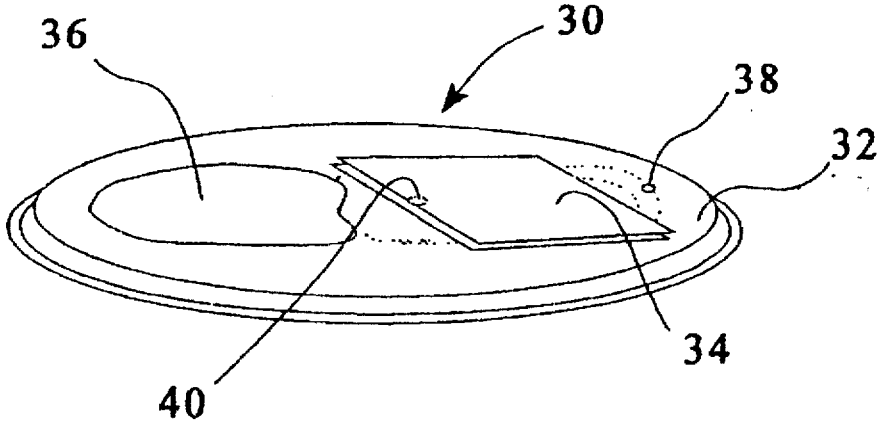
FIG. 5 is a perspective view of part of the apparatus according to a second embodiment of the present invention.

Turning now to FIG. 5, there is illustrated a further embodiment of the present invention. In this example, the flexible-walled receptacle comprises a bag 34 which is adhered to the under surface 32 of the can top 30. Again, the can top 30 is provided with an outlet hole 36 from which the beverage in the can can be poured.

The bag 34, which in FIG. 5 is shown in a flat folded state, is also provided with a charge hole 40 through which it can be charged with the appropriate refrigerant. Also, the can top 30 is provided with a bleed hole 38 having dimensions which allow for the escape of gas while preventing the escape of any liquid from the can.

Upon introduction of a charge of refrigerant to the folded bag 34, the bag is caused to expand in a manner similar to that discussed in relation to FIGS. 1–4 and, indeed, the expanded bag can have an appearance similar to that of the bag illustrated in FIG. 1.

The embodiment of FIG. 5 is particularly advantageous in that, prior to being charged, the bag 34 is provided on the under surface of a can top 30 in a manner which does not prevent, or interfere with, the usual stacking of such can tops and so which does not disadvantageously effect the storage, transportation or processing of the can tops 30, particularly during the formation of a completed can.

Preferably, the bag comprises a simple plastic bag adhered, for example, by glue, to the under surface 32 of the can top 30 and the charge hole 40 extends through the can top 30 and into the initially folded bag The bag 34 is adhered to the under surface 32 of the can top 30 in such a way that the charge hole 40 is sealed from the drink product. During the canning process, the drink product is advantageously introduced into the can as usual and the can top 30 placed on the can and crimped as usual. As mentioned above, the stacking of the can tops 30 is not disadvantageously effected by the inclusion of the folded bag 34 and so the present invention advantageously has no detrimental effect on the speed or efficiency of an automated canning process. Once the can is formed as noted above, the initially folded bag 34 is charged with refrigerant and the charging hole 40 then sealed by some appropriate re-openable sealing means.

As will be appreciated from the following discussion, the receptacle according to the present invention need not be initially mounted directly to a wall of the container and can advantageously be formed so as to become attached to the container at some appropriate location and at some stage subsequent to the introduction of both the drink product, and the receptacle, into the container. For example, a bag can advantageously be designed to attach itself to the upper region of a can, or bottle, by exerting its own pressure on the beverage and on the upper portion of the can or bottle. Receptacles according to these further features are advantageously arranged to be dropped into the container prior to the introduction of a beverage thereto. Also, prior to insertion of the receptacle into the container, a small charge of refrigerant material, for example dry ice or solid carbon dioxide, is inserted into the receptacle's before the receptacle's insertion into the container. After introduction of the small charge of refrigerant, the receptacle is sealed and the charge of refrigerant is generally only sufficient to provide for the floatation discussed below. The small charge of refrigerant can be inserted into the receptacle by way of any suitable reclosable means such as a self-sealing membrane of, for example, silicone rubber.

The re-liquifying of the small charge is most unlikely in view of the low boiling temperature of suitable gases.

The container is then filled with the drink product and, in view of the warming effect of the drink product on the small charge of refrigerant, the refrigerant evaporates and the receptacle is caused to expand and the pressure of the expanding receptacle is then transmitted to the beverage. The expanding receptacle, and the pressure exerted thereby, effects the floatation thereof in such a manner that the receptacle can be caused to effect a tight seal in the upper region of the container due to the pressure difference between the beverage medium and atmosphere. An appropriately placed aperture in the upper end wall of the container can advantageously allow for a pressure difference between the inside of the receptacle due to the expanding gas therein, and the atmospheric pressure found on the outside of the aforementioned aperture. The pressure difference arising therefrom advantageously serves to secure the, at least partly expanded receptacle to an upper end wall of the container. Additionally, or as an alternative, a glue patch or portion of food-grade double sided tape can be located on an underside surface of an upper end wall of the container so as to advantageously receive, and retain in a secure manner, the at least part expanded receptacle. As a preferred feature, the receptacle has a charge-exit aperture which is arranged to have dimensions small enough such that the rate of expansion of the receptacle will exceed the rate of loss of evaporated gas through this charge-exit aperture.

Once secured in this position, the bag is then charged with liquified gas refrigerant through a re-closable charge hole. Once charged, the charge hole, and the bleed hole if also employed, may then be sealed by an appropriate tape or plug sealing member or by any other appropriate form of sealing means. The eventual cooling charge can then advantageously be administered at any required time.

Since the operation and appropriate location of the receptacle as discussed above does not rely on any pressure generated by the drink product itself, the present invention can be advantageously employed with both carbonated and non-carbonated beverages. If carbonated beverages are involved, the carbonation pressure of the beverage will commence increasing as the container is sealed and this further enhances a strong seal by the receptacle.

Figure 6:
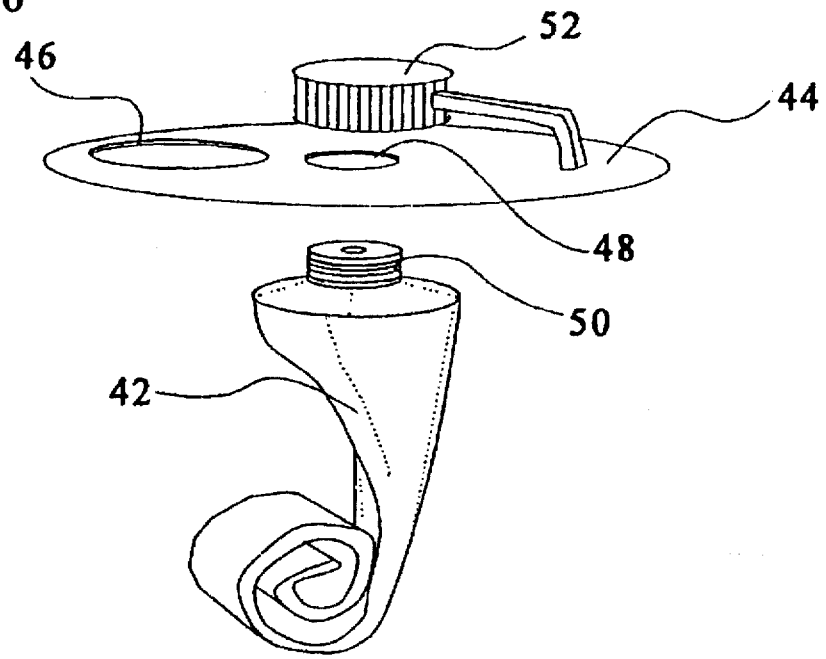
FIG. 6 is a perspective view of apparatus according to a third embodiment of the present invention.

FIG. 6 illustrates one form of a so-called "drop in" receptacle and which comprises a thin walled aluminium bag 42, which can be coiled into a compressed, or collapsed state, and which is arranged to be received in an annular membrane member 44 which has a drain hole 46 provided therein so as to provide for the pouring of the contents of a container in which the bag 42 is to be located. The annular member 44 is provided with a central aperture 48 which is arranged to receive a neck portion 50 of the bag 42.

An enclosure cap member 52 is provided attached to the annular membrane member 44 and so as to close off access to the bag 42 which is otherwise available via the neck portion 50.

Receptacles which float into the appropriate position in the aforementioned "self-attach" process can advantageously be formed from the impact extrusion of aluminium or by injection moulding of plastic. The annular membrane 44 illustrated in FIG. 6 is particularly advantageous for use with a receptacle formed of thin aluminium foil since it overcomes the need to secure the bag 42 to an upper region of the container by way of adhesive means. As will be appreciated from FIG. 6, the bag 42 and annular membrane member 44 are manufactured as separate elements and arranged to be attached to form a completed unit. If formed from plastic, the embodiment illustrated in FIG. 6 can be provided as a unitary member formed by injection and blow moulding. In any case, the bag 42 can be secured in its appropriate location within the container by means of thermal welding or by mechanical engagement formations.

With reference to FIG. 6, once dropped into an empty container, the bag 42 and annular membrane member 44 are disposed at the bottom on the container with the annular membrane member 44 facing upwards. The container is then filled with the drink product as usual and, until such time as the bag 42 begins to expand, the bag 42 and annular membrane member 44 remain at the bottom of the container. However, as mentioned above, once expansion of the bag 42 occurs, in view of the previously introduced small charge of refrigerant such as liquid carbon dioxide, or liquid nitrogen, the bag 42 and annular membrane member 44 then begin to float upwardly within the container and, for example, in the direction of arrow A as shown in FIG. 7.

Figure 7:
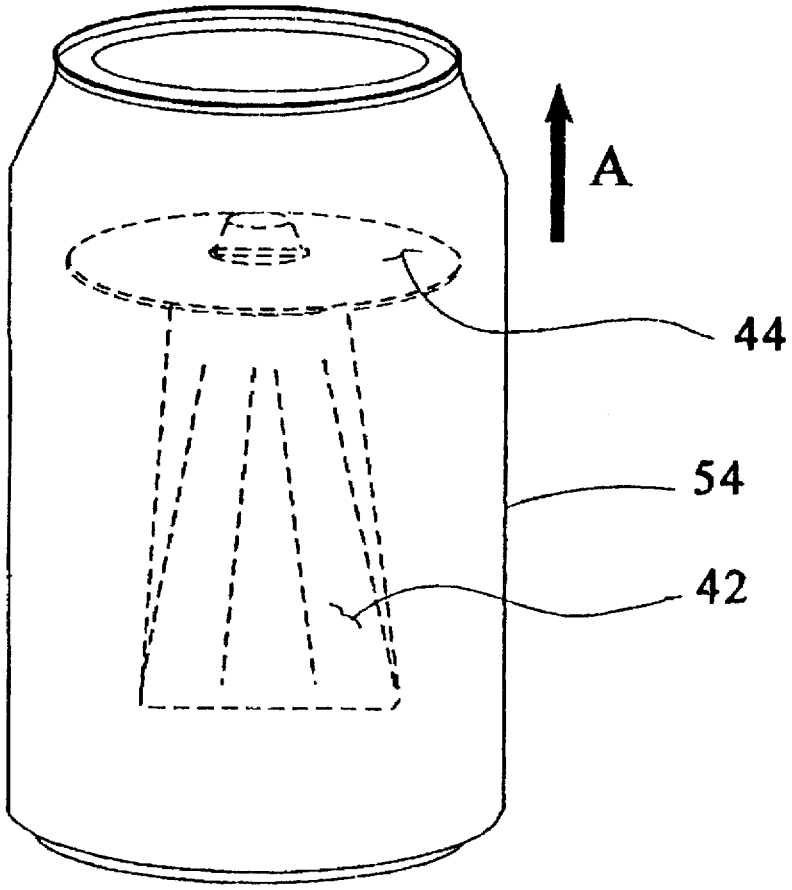
FIG. 7 is a perspective view of apparatus according to the third embodiment of the present invention.

FIG. 7 illustrates the passage of the bag 42 and annular membrane member 44 during the upward floatation thereof within a beverage contained in a can 54.

Figure 8:
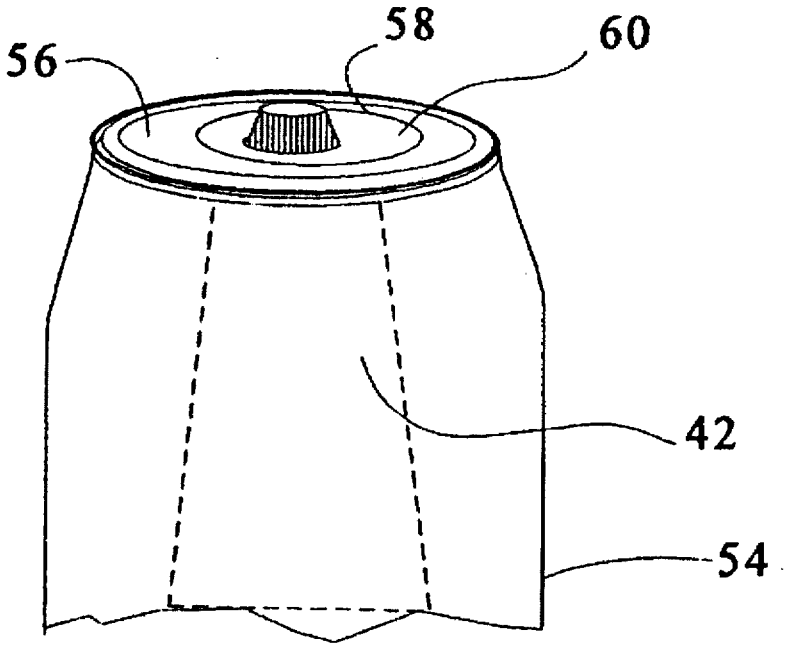
FIG. 8 is a perspective view of a variant of the apparatus according to the third embodiment of the present invention.

The can 54 is provided, as is clearly illustrated in FIG. 8, with a top surface arranged to receive the annular membrane member 44. The top surface 56 is designed specifically to mate with the annular membrane member 44 and to also eliminate problems that can arise with a conventional can-top and ring-pull arrangement.

As will be appreciated from the following description, the embodiment of FIGS. 7 and 8 provides for a can 54 which does not require the standard can-top or ring-pull mechanism. Instead of a standard ring pull mechanism, the can 54 of 8 is provided with an enlarged opening 58 which first receives the neck portion 50 and cap seal 52 of the bag 42 and then, in turn, is itself sealed by the upper surface of the annular membrane member 44. As will be appreciated from the following description, the membrane member 44 of FIGS. 7 and 8 corresponds to that of FIG. 6 with the exception of the omission of the drain hole 46. Again, the buoyancy of the expanded bag 42, and the pressure it exerts on the beverage within the can 54 serves to effectively and efficiently seal the annular membrane member 44 against the underside of the upper wall 56 of the can 54 so as to prevent the escape of the beverage from the can 54. Advantageously, once having arrived in the location illustrated in FIG. 8, the annular membrane member 44 can be arranged to engage with engagement formations on the under surface of the upper wall 56 of the can 54. Thus, should the can 54 become tilted, the annular membrane member 44 remains in its sealing position as illustrated in FIG. 8 due, in particular, to the pressure on the receptacle, and the pressure within the beverage exceeding the buoyancy force of the receptacle.

Figure 9:
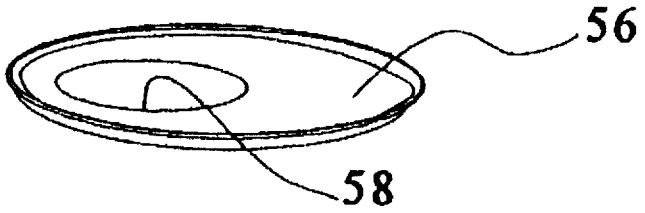
FIG. 9 is a perspective view of the lid of a beverage can according to the third embodiment of the present invention.

FIG. 9 clearly illustrates a can top that can be provided to advantageously receive the bag 42 and annular membrane member 44 of FIG. 6 by way of an aperture 58 which extends to a peripheral portion of the can top 56 so as to allow for the ready pouring of a beverage therefrom.

In the embodiments of FIGS. 6 to 8, the expanded and inflated bag 42 advantageously serves to displace all of the air and gases found in the head space above the beverage during the expansion of the bag 42. Further, the expansion of the refrigerant introduced into the bag 42 can be controlled by the size of the hole that extends through the annular membrane member 44 and the neck portion 50 of the bag 42. This dimension, in turn, serves to allow a certain minimum expansion volume to be maintained. The expulsion rate of the evaporating refrigerant that arises within the bag 42 is also controlled by the dimensions of the aforementioned passage extending through the neck portion 50 of the bag 42.

Figure 10:
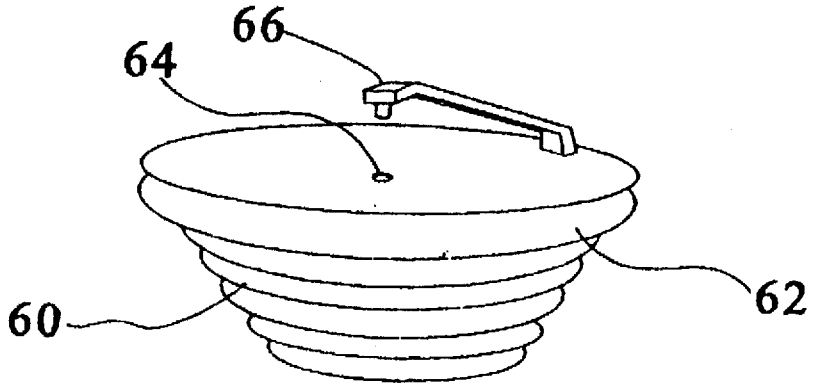
FIG. 10 is a perspective view of a receptacle according to a fourth embodiment of the present invention.
Figure 11:
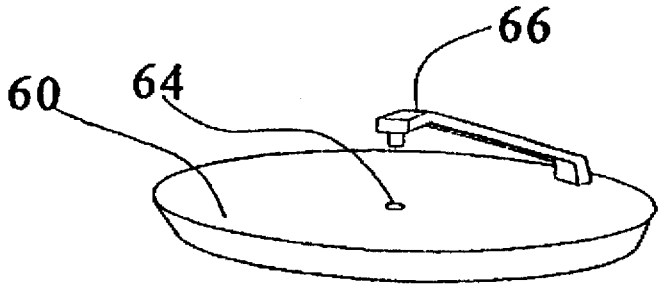
FIG. 11 is a further view of the fourth embodiment of the present invention.

FIGS. 10 and 11 illustrate further examples of a "self-locating" embodiment of the present invention.

The expandable/collapsible receptacle of FIGS. 10 and 11 comprises of a receptacle 60 formed of telescopic wall portion 62. The wall portions may themselves be rigid or flexible and the receptacle 60 is primarily expandable/collapsible in the direction of the telescopic action of the wall portions 62. In FIG. 10, the receptacle 60 is illustrated in a part expanded form and, as can be seen, the receptacle 60 includes an inlet/outlet aperture 64 which can be selectively closed by way of a plug member 66.

As will be appreciated from FIG. 11, once collapsed, the receptacle 60 occupies a relatively small volume compared with the maximum possible expansion thereof.

Advantageously, the receptacle 60 of the embodiment of FIG. 10 can be impact extruded to form a flexible aluminium canister which, as will be appreciated from the above description, can be arranged to receive a small charge of refrigerant by way of the inlet/outlet aperture 64. Once the inlet/outlet aperture 64 is sealed by way of the plug 66, the receptacle 60 is then delivered into a container and arranged to float upwardly within the container in the aforementioned manner. Thus, as the beverage warms the receptacle 60, the refrigerant is caused to evaporate and so effect the expansion of the receptacle 60 and thus achieve the required buoyancy thereof so as to achieve the appropriate location of the receptacle 60 in an upper portion of the container in which it is to be securely located.

Figure 12:
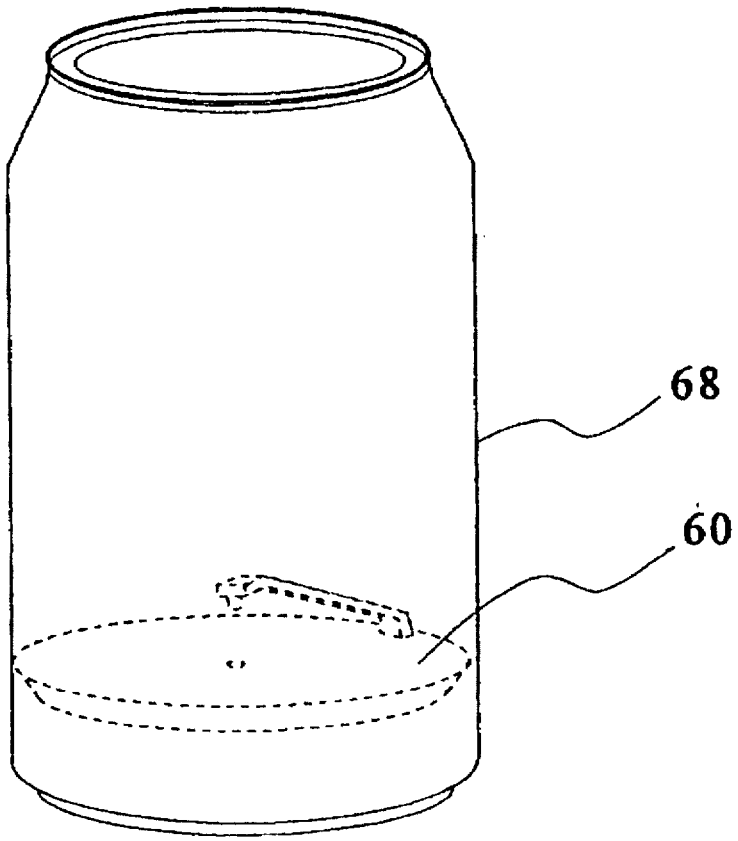
FIG. 12 is a perspective view of the receptacle of the fourth embodiment of the present invention in use.

FIG. 12 illustrates the receptacle 60 of FIG. 11, in its collapsed state, i.e. at the time of its location at the bottom of a can 68. As mentioned, the previously introduced charge of refrigerant causes the receptacle 60 to expand and float to the top of the can 68 in such a manner that it can form a seal with the peripheral portions of the upper walls of the can 68. Appropriate crimping of the upper portion of the can 68 allows for a secure engagement of the aforesaid upper portion of the can 68 with the outer peripheral regions of the receptacle 60.

The completed can 68 assembly can advantageously thereafter be transported to a charging station and, during this period, the receptacle receives a further charge of a refrigerant which serves to effect the further expansion of the receptacle 60 so as to occupy the required volume within the can 68. As mentioned before, the volume occupied by the at least part expanded receptacle 60 corresponds to the head space that would otherwise have been found above the beverage within the can 68. Once the pressure of the refrigerant in the receptacle 60 has reached the required value, i.e. so as to balance with the pressure of the beverage within the can 68 so as to avoid disadvantageously stressing the thin walls of the receptacle 60, the inlet/outlet 64 of the receptacle 60 can again be sealed.

As will be appreciated, the pressure of the receptacle is also transmitted to the beverage during the expansion of the receptacle and this serves to provide an even tighter pressure seal between the receptacle and the upper portion, or lid, of the can 68.

Figure 13:
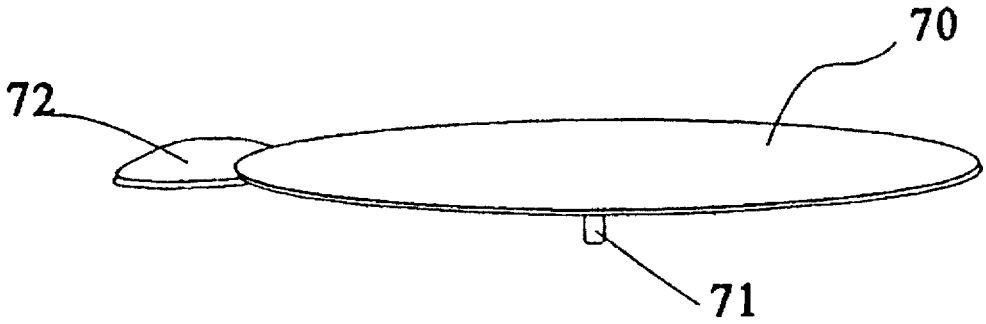
FIG. 13 is a perspective view of a receiving member for use with the arrangement of FIG. 12 and on an enlarged scale.

FIG. 13 is a perspective view of a sealing cap 70 that can be provided as an alternative to the plug member 66 illustrated in FIG. 10, for sealing the inlet/outlet aperture 64 of the receptacle 60.

The sealing cap 70 comprises a circular member having a downwardly extending plug 71 which is arranged to be received in the inlet/outlet aperture 64 of the receptacle 60. The circular portion of the sealing cap 70 also serves to prevent contamination and soiling of the pouring/drinking area of the can 68.

Further, a finger pull 72 is provided so as to extend from the sealing cap 70 and to assist in the removal of the sealing cap 70 and associated plug 71 so as to activate the refrigerant located in the receptacle 60.

Figure 14:
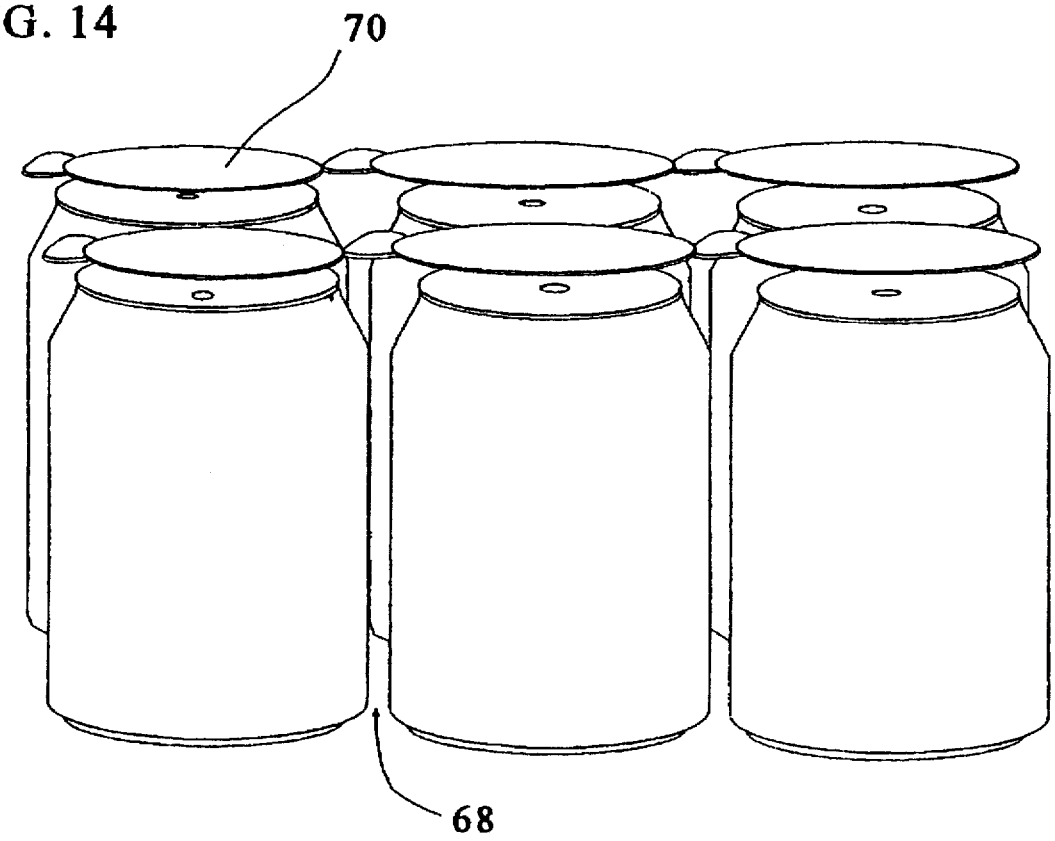
FIG. 14 shows a plurality of sealing members of FIG. 13 and in use in relation to a particular arrangement thereof.

As will be appreciated from FIG. 14, the sealing cap 70 can readily be provided as one of a series of advantageously connected caps which readily allow for the opening, and required refrigeration, of associated drinks cans and their respective beverages contents.

Whilst the aforementioned embodiments of the present invention have been discussed in relation to drinks cans, it will of course be appreciated that the invention can be provided for use with any form of container and which, in turn, can be arranged to contain any appropriate product, whether a food product, beverage or otherwise.

FIG. 15 again illustrates an embodiment of the present invention when arranged for cooling a fluid but, as will be appreciated, this particular embodiment of the present invention is arranged for use with a bottle.

Figure 15:
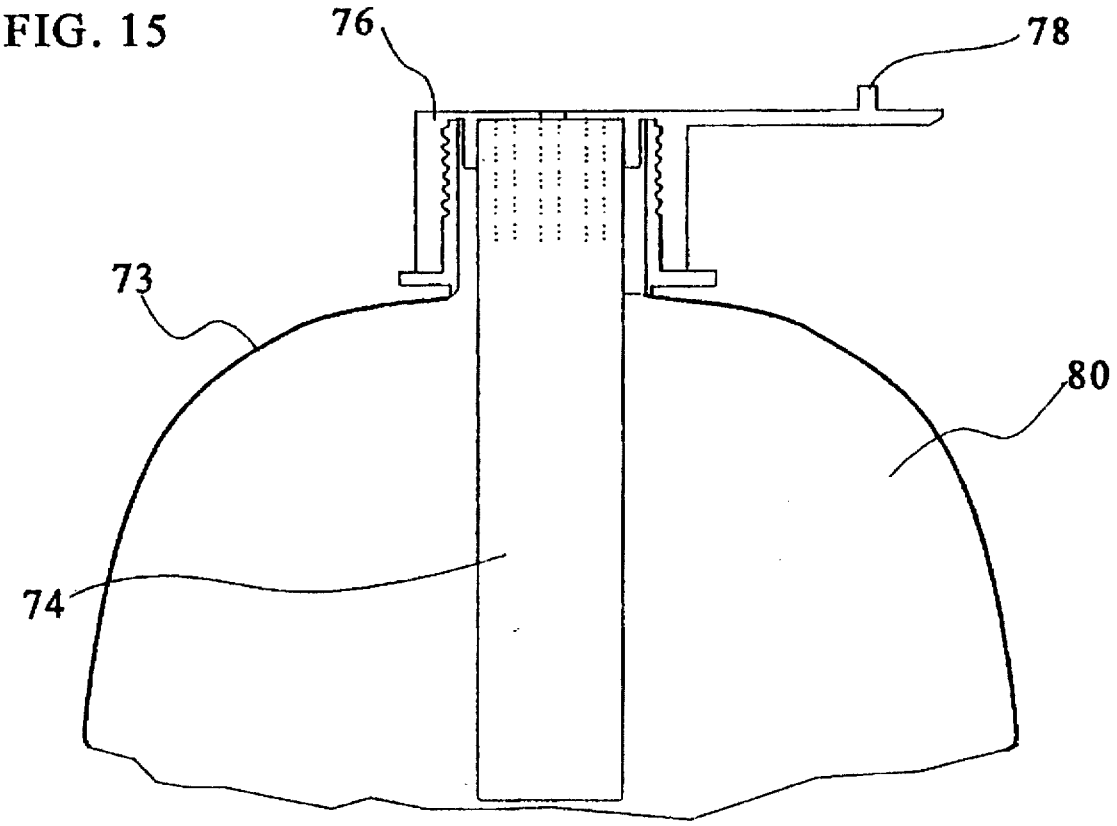
FIG. 15 is a sectional part view of a bottle having a receptacle according to a fifth embodiment of the present invention mounted therein.

Advantageously, a cap member arranged with a suitable folded receptacle can be provided and which can have a large beverage-delivery hole which can, in part, be sealed off by an upper portion of the receptacle, once expanded, the receptacle can form a tight fit with an inner portion of the bottle cap and itself has an aperture which can be plugged by a plug member connected to the cap. Such an arrangement is illustrated in FIG. 15 wherein a bottle 73, having a bag 74 in accordance with an embodiment of the present invention securely located therein, has a cap portion 76 which presents an aperture for communication with atmospheric pressure and temperature and which can be selectively sealed by means of a plug member 78. The bag 74 extends within the bottle 73 so as to contact the beverage 80 found therein. The bottle cap 76 can be glued or permanently welded to the bottle neck and so cannot be removed from the bottle in the ordinary manner.

As will be appreciated from the description that follows, once the refrigerant has been allowed to escape from the bag 74 by removal of the plug 78 from the associated aperture, and thus the refrigeration of the beverage 80 has occurred, partial collapse of the bag 74 is effected and the bag 74 can then advantageously fall away from the neck region of the bottle 73 so as to allow for the pouring of the beverage 80 from the bottle.

Figure 16:
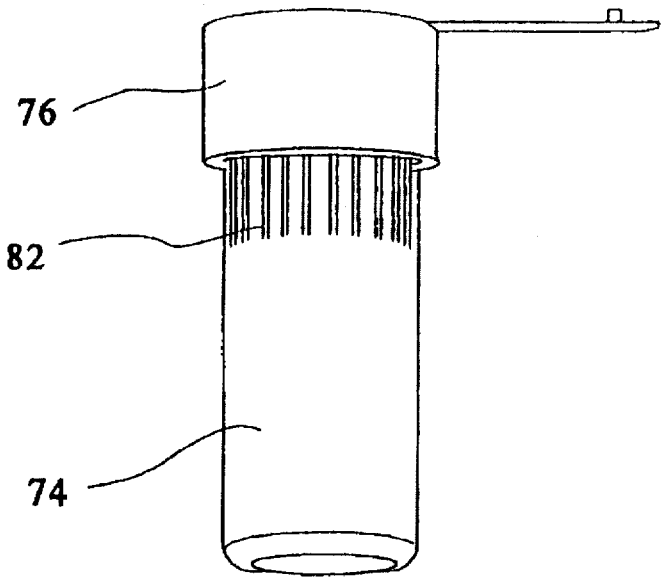
FIG. 16 is a perspective view of the receptacle of FIG. 15 and on an enlarged scale.

According to an alternative to the embodiment illustrated in FIG. 15, the bag 74 can be formed integral with the cap 76 and such a member is illustrated in FIG. 16. In FIG. 16, the bag 74 is illustrated in a compactly folded state, i.e. prior to the introduction of refrigerant thereto. The bag 74 is connected to the cap 76 by means of a cylindrical neck portion which is provided with engagement formations in the form of engagment formations 82 around the surface thereof.

A bottle, not shown, which is arranged to receive the combined bag/cap of FIG. 16 also has engagement formations for engagement with the engagement formations 82 of the aforementioned neck portion of the combined bag/cap. The neck portion is arranged to undergo minor radial expansion when the bag 74 is caused to expand by the introduction of refrigerant thereto and the expansion of the neck portion serves to effect secure biting engagement between the respective engagement formations of the neck region and the inner surface of the bottle. Thus, insofar as the pressure of the refrigerant is maintained within the bag 74, the cap 76, which has an internal threaded surface meshing with a threaded outer surface of the bottle's neck, cannot be removed from the bottle in view of the biting engagement between the two aforementioned engagement formations. Thus, the bottle cannot be opened until such time as the refrigerant has been released from the bag 74, the bag and neck portion collapsed and retracted, and so the beverage associated therewith appropriately cooled.

Once the bag 74 has collapsed, and thus the neck region carrying the engagement formations 82 likewise retracted, rotation of the combined bag/cap can be achieved relative to the bottle so as to allow for the removal of the combined bag/cap from the bottle and thus retrieval of the advantageously recently cooled beverage from the bottle.

As will be appreciated from the aforementioned bottle-related versions of the present invention, the receptacle for receiving the refrigerant can form a seal with the cap or can replace the cap entirely, irrespective of this, the charging of the bottle so as to cause the at least partial expansion of the receptacle can advantageously be achieved with the bottle cap partially screwed on to relieve the internal pressure which arises due to the expansion of the receptacle. The beverage is displaced as the receptacle expands to the required size until all air and gases above the beverage have been pushed out of the bottle via the partially screwed-on cap. The cap is then tightly attached to the bottle so as to achieve the required sealing and thus maintain the beverage in the bottle.

Figure 17:
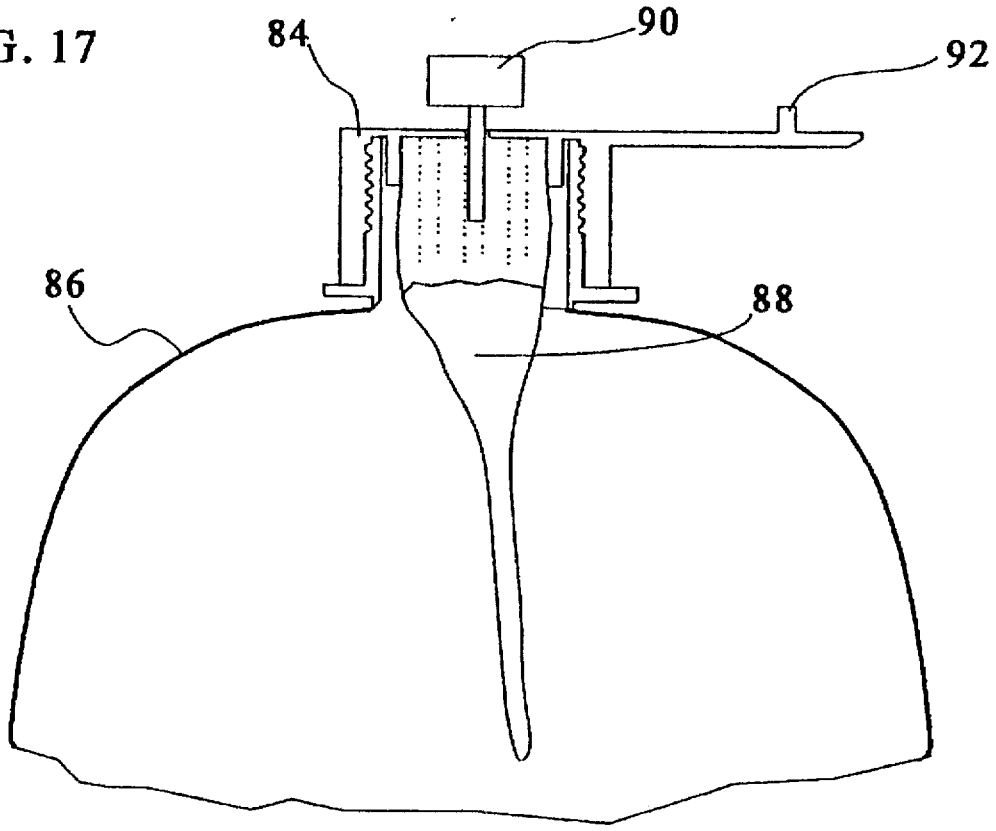
FIG. 17 is a sectional part view of a receptacle mounted within a bottle and in accordance with a sixth embodiment of the present invention.

FIG. 17 serves to illustrate the partially screwed-on location of a cap 84 associated with a bottle 86. As illustrated, a bag 88 is in communication with a charge valve 90 for delivering a charge of refrigerant to the bag 88 and in a manner which causes the bag 88 to expand and exert pressure on the beverage within the bottle 86 as illustrated in FIG. 17. A sealing cap member 92 is arranged to seal the entrance into the bag 88 once the charge valve 90 has been removed therefrom.

Figure 18:
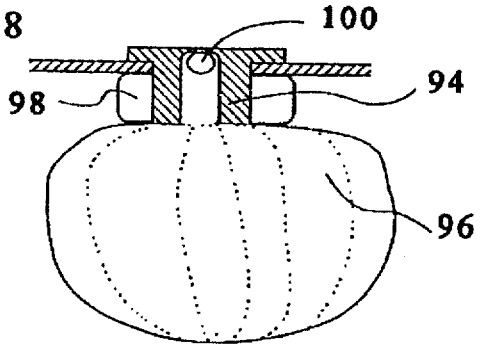
FIG. 18 is a sectional part view of an embodiment of the present invention serving to illustrate a valve seal for use with the present invention.

FIG. 18 illustrates a sectional part view of a neck member 94 for extending towards atmospheric pressure and temperature from a bag 96 according to an embodiment of the present invention. The neck member 94 is sealed to a wall portion of a container in which the bag 96 is located by means of an annular compressed sealing member 98, such as that discussed in relation to FIGS. 1–4, and, within the aperture leading from the inside of the bag 96 to atmosphere, there is provided a ball-valve member 100 which is arranged to move under the influence of gravity. Thus, when the apparatus illustrated in FIG. 18 is inverted from the position as shown in FIG. 18 the ball-valve member 100 engages a valve seat and serves to close off the passage leading from the inside of the bag 96 so as to prevent the undesired spillage of any liquid refrigerant remaining within the bag 96. Also, the ball-valve member 100 can serve to prevent the undesired escape of the pressurised refrigerant within the bag 96.

FIGS. 19 and 20 illustrate an embodiment of a receptacle according to the present invention which is somewhat similar to the embodiment illustrated with reference to FIGS. 1 to 4. However, in FIGS. 19 and 20, there is provided a folded bag 102 connected to a flanged portion 104 by way of a deformable neck region 106. FIG. 20 shows the embodiment of FIG. 9 once having been securely located through an aperture in the wall 108 of a container and in a position in which the deformable neck region 106 has been deformed so as to provide for the required sealing around the aperture in the wall 108 through which the bag 102 extends. Also, the bag 102 is shown in an initially expanding state during the introduction of refrigerant thereto.

The embodiment of FIGS. 19 and 20 differs from the embodiment of FIGS. 1–4 in that, in FIGS. 19 and 20, the bag 102, flange portion 104 and deformable neck region 106 are provided as an integral unitary member.

Such a unitary member can advantageously be formed by way of an injection moulding process and FIGS. 21 and 22 comprise schematic representations of apparatus 110 that can advantageously be used for this process.

Referring to FIG. 21, hot melt material is introduced into the inlet 112 and then directed into the compressed mould cavity 114. Once the injection process is complete, pneumatic cylinders 1167 are employed to separate the mould portions as shown in FIG. 22 so as to allow for the release of the finished unitary product. Advantageously, the mould consists of a three part mating mould which, as mentioned above, can produce, in one shot, the desired shape and form of receptacle and associated mounting flange and neck region.

As will be appreciated from the above, there are a variety of embodiments, not all of which have been illustrated herein, of the present invention which allow for the introduction of a receptacle into a container and which receptacle can then receive any appropriate refrigerant.

Thus, it should be appreciated that, by the time the container reaches the consumer/customer, the container has the required product, for example beverage, therein and the appropriate receptacle has been charged with the required refrigerant. In order to activate the cooling apparatus according to the present invention, the customer merely has to break the seal found in the wall of the container, i.e. remove the plug provided with the embodiments illustrated herein, so as to open the inside of the receptacle to atmosphere. Refrigerant gas that has evaporated within the receptacle then escapes from within the receptacle to atmosphere, and thus escapes from within the container, and further liquid refrigerant is caused to evaporate, and escape to atmosphere, in a similar manner so as to effect further cooling of the contents of the container.

The pressure of the contents of the container on the receptacle assists in the collapse thereof and in the continued expulsion of the refrigerant therefrom.

Thus, once the receptacle is fully collapsed, it will be appreciated that all of the refrigerant has been employed in cooling the contents of the container and has now escaped to atmosphere leaving merely the cooled contents for consumption as required.

As will be appreciated from the aforementioned description, there are a variety of means for ensuring that the collapsed receptacle does not interfere with the pouring, or direct drinking, of the contents of the container. For example, insofar as some gas remains in the receptacle, the tipping of the container so as to pour out the contents thereof, causes the receptacle to float away from the mouth or other opening of the container. At the end of the aforementioned cooling cycle, the pressure within the receptacle reduces to atmospheric pressure and, any seal that was previously provided by way of the buoyant receptacle, is then broken so as to allow for retrieval of the liquid product from the container.

The present invention works most advantageously with a refrigerant having good thermodynamic properties at room temperature. Such a refrigerant may be an HFC such as HFC-152a or Dymel-152a, or HFC-134a. As mentioned above, during the cooling process, the refrigerant evaporates to atmosphere via a hole in the receptacle and the thin wall of the receptacle takes heat out of the contents of the container so as to maintain the evaporation of the refrigerant and thus cause its change from its liquid phase to its gaseous phase. As is commonly understood, this leads to an appropriate cooling of the contents of the container.

The present invention is particularly advantageous in that the provision of an expandable/collapsible receptacle serves to ensure that the refrigerant always occupies a maximum surface area independent of the actual volume of refrigerant left during the evaporation process. As the refrigerant pressure reduces, the receptacle according to the present invention collapses and squeezes the refrigerant into a smaller volume. This collapse is caused by the weight of the contents of the container surrounding the receptacle and, although carbonation pressure within some beverage products may be relied upon to collapse the receptacle after the cooling process is complete, this is not absolutely necessary. The weight of the beverage around the collapsible receptacle is enough to collapse the receptacle to the required degree. This collapse, which is caused by a loss of pressure of the refrigerant now forces the receptacle to occupy a smaller volume while maintaining the surface area in contact with the beverage. Thus, the refrigerant will advantageously always be contacted by the maximum surface area of the receptacle even while the volume of the refrigerant decreases due to the evaporation.

The material forming the walls of the receptacle advantageously has sufficient flexibility to allow for continued deformation of the receptacle during the continuing evaporation of the refrigerant and so, in maintaining a constant surface area in contact with both the contents of the container and decreasing volume of refrigerant, the rate of evaporation, or of "boiling off" of the refrigerant can remain generally steady as the volume of refrigerant decreases.

Since low pressure in the receptacle causes the receptacle to collapse, and this collapse decreases the volume within the receptacle and increases the exposed area of the refrigerant to the contents, for example a beverage, this increase in the surface area of contact reinforces the evaporation of the refrigerant thereby increasing the pressure in the receptacle and so steadying, or slightly increasing the volume inside the receptacle, and so steadying the evaporation and cooling processes.

In this manner, the receptacle forms an important link in a feedback mechanism which serves to achieve a substantially constant evaporation rate and so potentially cool the contents of the container in a particular even, efficient and effective manner.

It is particularly advantageous that flammable gases can be employed as refrigerant in the present invention since the velocity of the gas exiting from the receptacle can readily be made high enough to exceed the flame speed limit of the gas. This advantageously prevents any combustion from occurring even when the gas is ignited at its exit from the receptacle.

A wide range of commonly available inflammable gases can therefore advantageously be used as refrigerants in the receptacle of the present invention without limiting its functionality. Although any combination of gases with the appropriate properties may be employed, particularly advantageous examples are HFC-152a and HFC-134a.

Particular advantages will of course be apparent from the preceding description. For example if a carbonated beverage is involved, the carbonation of the beverage is actually conserved by the receptacle since the contents of the receptacle will now perform the function previously performed by the dead carbonation gas in a standard beverage container. Also, the refrigerant within the receptacle will allow for the expansion and contraction of the beverage during changes in ambient temperature. Since the carbonation is suppressed until the receptacle is activated, i.e. open to atmosphere, the carbonation in the beverage is conserved until the beverage is required to be consumed.

According to a particular feature of the invention, the entire potential surface area of the receptacle is available for the heat exchange process and, as the receptacle collapses, so as to reduce the volume of the refrigerant therein, the refrigerant comes into contact with an ever increasing area of the inner wall of the receptacle, and thus, indirectly, an ever increasing area of thermal contact with the containers contents.

Advantageously, the apparatus of the present invention can be 100% recyclable. The plastic advantageously used for forming the receptacle can be the same as that used in forming plastic beverage bottles and the aluminium foil receptacle is also 100% recyclable.

With further reference to a carbonated beverage, the receptacle is particularly advantageous in that the loss of pressure from the receptacle can be arranged to be faster than the carbonation pressure build up so that, in situations where the receptacle is provided to seal an outlet of the container, the carbonation pressure build up does not retain the receptacle in its sealing position in relation to the outlet and so allows for the receptacle to move away from the outlet.

The pressure built up within the receptacle can be appropriately selected but, in one particular example, is no more than 60 PSI at full charge and at a temperature of 28% centigrade. Although the apparatus of the present invention will achieve the refrigeration of the contents of the container at a slower rate when located in a cold environment, effective refrigeration is still achieved. In hot environments, the apparatus of the present invention will generally be under higher pressure and so will assist in cooling the contents of the container more than would be expected in a cooler environment.

The receptacle of the present invention is particularly advantageous since one size is suitable for use with a large variety of different size containers and this enhances the economic viability of the present invention. Also, the refrigerant suitable for use with the present invention can comprise non-ozone-depleting refrigerants so that the present invention can be considered to be quite environmentally friendly.

As regards potential malfunction of the apparatus to the present invention, if the receptacle is defective during the canning/bottling process, it will not hold the required pressure of refrigerant and, in instances where the receptacle is to form a seal, such a defect will be readily identifiable.

Also, as regards the bottling/canning process, the receptacle may be charged before, during or after the containers passage along the processing line such that the present invention can be readily incorporated into currently established automated production lines.

The invention is not restricted to the details of the foregoing embodiments.

For example, the invention can be used with any appropriate container serving to contain any appropriate material that advantageously needs to be cooled at a particular time. Whilst finding particular use in the drinks industry, it should be appreciated that the concept of the present invention can be readily incorporated into a container for use with any form of food product or other product as required.

Also, although some of the aforementioned features have been discussed in relation to a can, and some in relation to a bottle, it should be understood that the particular aspects of the present invention depend very little upon the nature of the container and so the various features illustrated with cans could be readily incorporated into other containers such as bottles and vice versa.

Further, although a ball valve member has been illustrated for preventing liquid refrigerant from escaping from the receptacle, another arrangement for preventing such spillage can be achieved by employing two or more flexible-walled receptacles forming multiple skin layers around a refrigerant chamber. Thus, by employing this "onion skin" of multiple layers, the refrigerant in its liquid phase must pass through a labyrinth of narrow passages before exiting from the receptacle, by which time, full evaporation of the refrigerant can generally be ensured. Also, several flexible-walled receptacles can be connected in series, or in parallel, to form a heat exchange receptacle having a large surface area and multiple compartments for the storage of portions of refrigerant charge. This has the advantage that the refrigerant can be stored over a large surface area and it is therefore possible to form, as required, a plurality of chambers to provide for heat exchange surfaces and refrigerant store chambers simultaneously. Further, it is also possible to form a variety of surface patterns for maximum exposure of the refrigerant to different levels of the contents of a container.

The present invention has a variety of major advantages. For example, the flexible-walled receptacle is not subjected to any stress since it is supported on all sides by its own transfer pressure acting on the contents of the container. The maximum stress on the receptacle wall is no more than that due to any particular change in shape that occurs. This means that, at full pressure, the collapsible walls of the receptacle will not be stretched or subject to any hoop or lateral pressure stresses. Thus, a simple glue bond, or two sided tape adhesion, between the receptacle and an inner wall of the container can readily be achieved as discussed above.

The content of the container is also prevented from escaping while the receptacle is pressurised with refrigerants since a portion of the receptacle wall can form a seal around an outlet opening of the container. Also, the maximum available free volume within the container can be used to store the refrigerant since the receptacle will readily expand to fill the maximum available volume within the container.

Any carbonation within the beverage does not escape, nor is the beverage easily exposed to the atmosphere which can have a disadvantageous effect on the taste of the beverage. Since the operation of the present invention does not depend upon carbonation pressure within a beverage, the carbonation pressure can advantageously be retained until the cooling process is over and the beverage is ready for consumption.

Further, the maintenance of the pressure within the beverage also assists in maintaining other pressure/release devices associated with beverages, i.e. those for providing a creamy head to canned beer, intact. The surface area of the receptacle available for the heat exchange process can advantageously be maximised at little or no additional cost during manufacture by simply re-arranging the topology of the receptacle. The volume of the container's contents displaced by the flexible wall of the receptacle is negligible in view of the thin-walls employed.

As mentioned above, any internal hoop and lateral wall pressure stresses within the receptacle according to the present invention are negligible since the receptacle expands to a state of equilibrium between the pressures inside and outside of the receptacle and, further, there is little or no chance of an internal explosion occurring.

The receptacle may advantageously be charged at any time during or after the beverage filling process and so the invention can be readily incorporated into any high speed production line such as a high speed canning or bottling production line.

Also, as a further alternative, the receptacle can be arranged to occupy a volume less than, for example, the head space of in the container so that, if required, the remaining space in the container can be occupied by, for example, pressurized gas.

Finally, from the above description, it will of course be appreciated that a particularly important aspect of the present invention is the ability of the surface area, the volume and the shape of the receptacle arranged to receive the refrigerant to change in response to any variations in the pressure internal or external to the receptacle.

It will be appreciated that other modifications and variations may be made to the embodiments described and illustrated within the scope of the present application.

We claim:

1. A rapid refrigeration apparatus comprising: a container means comprised of a top and bottom wall sealingly connected to a side wall to define an interior chamber therein, one of said walls having a first aperture means for accessing said interior chamber; a receptacle means disposed within said interior chamber, said receptacle means constructed from a material of nominal thickness having a variable volume containing a refrigerant maintained in a state in which pressure inside said receptacle equals pressure of contents placed outside said receptacle; a second aperture means positioned in one of said walls of said container means enabling atmospheric communication between said receptacle means for controlled evaporation of said refrigerant; wherein said receptacle refrigerant is voluntarily released through said second aperture means thereby causing a rapid lowering of content temperature of said container means.

2. The rapid refrigeration apparatus according to claim 1 wherein said receptacle means partially expands upon receipt of said refrigerant allowing for expulsion of said refrigerant by evaporation through said second aperture means providing at least a partial collapse of said receptacle means upon expulsion of said refrigerant.

3. The rapid refrigeration apparatus according to claim 1 wherein said receptacle means is responsive to pressure increases upon insertion of said refrigerant wherein said receptacle is retained in such a state as to inhibit full expansion of said receptacle means by having pressure inside said receptacle equal pressure of contents placed outside said receptacle.

4. The rapid refrigeration apparatus according to claim 1 wherein said second aperture means includes a selectively openable sealing means, said selectively openable sealing means having a resealable closure member.

5. The rapid refrigeration apparatus according to claim 1 wherein said receptacle means provides an impervious barrier between said refrigerant and container contents.

6. The rapid refrigeration apparatus according to claim 1 wherein said receptacle means is constructed of a rigid material defining a predefined volume having at least one slidable wall member.

7. The rapid refrigeration apparatus according to claim 6 wherein said receptacle is constructed of a one-piece flexible balloon type bladder expandable along a substantial portion of said interior chamber of said container means.

8. The rapid refrigeration apparatus according to claim 6 wherein said receptacle means is constructed from metal of nominal thickness.

9. The rapid refrigeration apparatus according to claim 6 wherein said receptacle means is constructed of a non-metallic material.

10. The rapid refrigeration apparatus according to claim 7 wherein said flexible balloon type bladder is arranged to effect sealing of said first aperture means to prevent an undesired access to the contents therein.

11. The rapid refrigeration apparatus according to claim 2 wherein said partial collapse of said receptacle means maintains a predefined surface area for contact with contents in said container means to maintain the required evaporation process during the expulsion of said refrigerant.

12. The rapid refrigeration apparatus according to claim 1 including a mounting member disposed within said second aperture means, said mounting member having a passage and a sealing member allowing for resealing of contents within said container means.

13. The rapid refrigeration apparatus according to claim 12 wherein said receptacle means is hermetically sealed to said container means.

14. The rapid refrigeration apparatus according to claim 1 wherein said refrigerant may be any suitable gas such as dimethyl ether, HFC-134a, HFC-152a or a combination thereof.

15. The rapid refrigeration apparatus according to claim 1 wherein said container means may be constructed from a conventional beverage can having a finger pull as said first aperture including a sealing cap attached to said first aperture pull whereby opening of said sealing cap by pulling said finger pull allows fluid communication between said receptacle means and the atmosphere.

16. The rapid refrigeration apparatus according to claim 1 wherein said receptacle means is receptive to a predefined charge of supercooled gas wherein evaporation of a liquid gas causes said receptacle to expand and float upwardly allowing ease of positioning said receptacle in said container means.

17. The rapid refrigeration apparatus according to claim 1 wherein said second aperture means includes a means for expulsion of gas at a velocity exceeding the flame speed limit of said gas allowing said gas to include flammable constituents.

18. A rapid refrigeration apparatus comprising:

a container means having liquid container contents;

a receptacle means enclosed within said container means, said receptacle means comprising a flexible receptacle wall and containing a refrigerant;

refrigerant release means for releasing said refrigerant into the atmosphere; said release means comprising a release means activation means for voluntarily opening said release means at a selected moment in time. receptacle wall such that said refrigerant in its liquid phase must pass through an extended path before exiting from said receptacle through said refrigerant release means, thereby providing fuller evaporation of said refrigerant for enhanced cooling of said container contents.

19. A rapid refrigeration apparatus comprising:

a container means having container contents;

a receptacle means enclosed within said container means, said receptacle means comprising a flexible receptacle wall and containing a liquid refrigerant;

refrigerant release means for releasing said refrigerant into the atmosphere; said release means comprising a release means activation means for voluntarily opening said release means at a selected moment in time, such that operation of said activation means opens an aperture on the surface of said container means enabling fluid communication between said receptacle means and the atmosphere, causing a gradual evaporation and release of said refrigerant into the atmosphere and thereby lowering the temperature of the liquid refrigerant remaining in said receptacle means and causing the pressure of the evaporated gaseous refrigerant above said liquid refrigerant to decrease and collapse the flexible receptacle means and drawing heat from said container contents into said receptacle means, said heat subsequently causing the pressure of said gaseous refrigerant in said receptacle means to increase and expand the flexible receptacle wall, in a repeating cycle of flexible wall expansions and contractions thereby stirring said container contents for more rapid and efficient container contents cooling.

20. A rapid refrigeration apparatus comprising:

a container means;

a receptacle means having a variable volume and being enclosed within said container means defining a variable first volume within said receptacle means and a variable second volume between said receptacle means and said container means, one of said variable first volume and said variable second volume containing a refrigerant and the other of said variable first volume and said variable second volume containing a beverage, such that said receptacle means expands within said container until pressure equilibrium is reached between said refrigerant and said beverage;

refrigerant release means for releasing said refrigerant into the atmosphere; said release means comprising release means activation means for voluntarily opening said release means at a selected moment in time.

21. An apparatus according to claim 20, wherein said receptacle means comprises a telescoping vessel having variable surface area;

such that said variable first and second volumes are substantially free to increase and decrease with any pressure variations during refrigerant release to stir said container contents for more rapid and efficient cooling of said container contents.

22. An apparatus according to claim 20, wherein said receptacle means comprises a flexible bladder having a substantially constant surface area;

such that said variable first and second volumes are substantially free to increase and decrease with any pressure variations during refrigerant release to stir said container contents for more rapid and efficient cooling of said container contents.

23. An apparatus according to claim 20, wherein said flexible bladder is positioned within said container means such that said flexible bladder bears against and seals said refrigerant release means prior to triggering of said release means activation means.

24. A method of rapid refrigeration comprising the steps of:

enclosing a refrigerant receptacle means having a flexible receptacle wall within a container means;

placing liquid refrigerant into said receptacle means;

placing container contents into said container means;

opening an aperture means in said container means to open fluid communication between said receptacle means and the atmosphere, thereby causing said liquid refrigerant to gradually escape through said aperture means and draw heat from said contents of said container means;

oscillating said flexible receptacle wall inwardly and outwardly subsequent to opening said aperture means and during said refrigerant evaporation to stir said contents of said container means for more rapid and efficient cooling of said contents of said container means.

25. A rapid refrigeration apparatus comprising:

a container means having container contents;

a receptacle means enclosed within said container means, said receptacle means comprising a telescoping vessel having variable surface area and containing a refrigerant and having a variable volume such that said receptacle means expands within and against said container contents until pressure equilibrium is reached with said container contents;

refrigerant release means for releasing said refrigerant into the atmosphere; said release means comprising release means activation means for voluntarily opening said release means at a selected moment in time.

means for expanding and reducing the volume of said receptacle means and thereby expanding and reducing said receptacle means surface area to stir said container contents for more rapid and efficient cooling of said container contents.

* * * * *